US009388481B2

(12) United States Patent
Frommeyer et al.

(10) Patent No.: US 9,388,481 B2
(45) Date of Patent: Jul. 12, 2016

(54) HIGH STRENGTH, OXIDATION AND WEAR RESISTANT TITANIUM-SILICON BASED ALLOY

(71) Applicant: ELKEM AS, Oslo (NO)

(72) Inventors: Georg Frommeyer, Ekrath (DE); Karl Forwald, Kristiansand S (NO); Gunnar Halvorsen, Kristiansand S (NO); Kai Johansen, Kristiansand S (NO); Oyvind Mikkelsen, Kristiansand S (NO); Gunnar Schussler, Kristiansand S (NO)

(73) Assignee: Elkem AS, Oslo (NO)

( * ) Notice: Subject to any disclaimer, the term of this patent is extended or adjusted under 35 U.S.C. 154(b) by 0 days.

(21) Appl. No.: 14/582,519

(22) Filed: Dec. 24, 2014

(65) Prior Publication Data

US 2015/0118099 A1 Apr. 30, 2015

Related U.S. Application Data

(63) Continuation of application No. 10/935,934, filed on Sep. 8, 2004, now abandoned.

(30) Foreign Application Priority Data

Jul. 13, 2004 (NO) ..... 20042959

(51) Int. Cl.
*C22C 14/00* (2006.01)

(52) U.S. Cl.
CPC ..... *C22C 14/00* (2013.01)

(58) Field of Classification Search
CPC ..... C22C 14/00
USPC ..... 420/418
See application file for complete search history.

(56) References Cited

U.S. PATENT DOCUMENTS

| | | | | |
|---|---|---|---|---|
| 2,786,756 | A | 3/1957 | Swazy et al. | |
| 2,818,333 | A | 12/1957 | Swazy et al. | |
| 2,818,335 | A | 12/1957 | Swazy et al. | |
| 3,963,525 | A * | 6/1976 | Bomberger et al. | 420/418 |
| 5,458,705 | A | 10/1995 | Mazur et al. | |
| 5,792,289 | A * | 8/1998 | Morton et al. | 148/421 |

OTHER PUBLICATIONS

Frommeyer, et al; Structures and properties of the refractory silicides, Ti5Si3 and TiS2 and Ti-Si(A1) eutectic alloys; May 2004.

* cited by examiner

*Primary Examiner* — Jessee Roe
*Assistant Examiner* — Christopher Kessler
(74) *Attorney, Agent, or Firm* — Lucas & Mercanti, LLP

(57) ABSTRACT

The present invention relates to high strength, oxidation and wear resistant titanium-silicon base alloy containing:

2.5-12 wt % Si
0-5 wt % Al
0-0.5% B
0-2% Cr
0-1 wt % rare earth metals and/or scandium
balance Ti with unavoidable impurities.

6 Claims, No Drawings

HIGH STRENGTH, OXIDATION AND WEAR RESISTANT TITANIUM-SILICON BASED ALLOY

CROSS REFERENCE TO RELATED APPLICATION

This application is a continuation of U.S. application Ser. No. 10/935,934, filed Sep. 8, 2004, now abandoned, which claims priority to Norwegian Application No. NO/20042959, filed Jul. 13, 2004, the applications are incorporated herein by reference in their entirety.

FIELD OF INVENTION

The present invention concerns high strength silicon-containing titanium-based alloys with optionally additives of aluminium, boron, chromium, scandium and rare earth metals (Y, Er, and Ce and La containing misch metal).

BACKGROUND ART

A variety of two phase α/β-titanium and near α-titanium alloys, such as Ti—6Al—4V, IMI 834 (Ti—5.8—Al—4Sn—3Zr—0.7Nb—0.5Mo—0.35Si—0.06C) and TIMET 1100 (Ti—6Al—2.7Sn—4Zr—0.4Mo—0.45Si) show great potential application in the air plane and space industry.

Among them Ti—6Al—4V exhibits the broadest application due to an optimum combination of high strength and fracture toughness and excellent fatigue properties at room and elevated temperature. These alloys have, however, some disadvantages such as a poor oxidation resistance above 475° C. (α-case formation), insufficient creep strength at 600° C. and higher temperatures and a poor wear resistance at room and elevated temperatures. The α-case causes crevice formation on the oxidised surface and has a detrimental effect on the fatigue properties. The arc melting process of these relatively high melting point alloy of about 1660° C.) and the necessary melt overheating to about 1750 to 1770° C. is a very energy consuming procedure for the manufacture of investment castings for the air plane and automotive industry, and engineering purposes in general.

Low silicon-containing titanium-based alloys are well known. Thus JP 2002060871 A describes a titanium alloy containing 0.2-2.3 wt % Si, 0.1-0.7 wt % O (total content oxygen), and 0.16-1.12 wt % N and 0.001-0.3 wt % B and remainder of titanium including unavoidable impurities, used for as cast products. These are e.g. golf club heads, fishing tackles and medical components such as tooth root, implants, bone plates, joints and crowns. The low silicon-containing titanium-based alloy does, however, suffer from a disadvantage, by forming small needle like $Ti_3Si$ precipates along grain boundaries, which decrease the fracture toughness and ductility of this material.

There is thus a need for an alloy that has a high strength at high temperatures, has a lower melting point than the Ti—Al—V alloys and has good casting properties.

DESCRIPTION OF INVENTION

By the present invention it is provided Ti—Si alloys with relatively high silicon contents which exhibit a relatively low melting point due to their eutectic constitution, good casting properties and high strength at higher temperatures as well as a very high resistance to oxidation and creep deformation at high temperatures.

The present invention thus relates to a Ti—Si alloy comprising 2.5-12 wt % Si, 0-5 wt % Al, 0-2 wt % Cr, 0-0.5 wt % B, 0-1 wt % rare earth metals and/or Sc, the remaining except for impurities being Ti.

According to a preferred embodiment the alloy contains 0.3-3 wt % Al, and more preferably 1.1 to 3 wt % Al.

According to another preferred embodiment the Ti—Si alloy contains 6-9 wt % Si and 1.2-2.5 wt % Al.

A particularly preferred alloy is the eutectic alloy containing about 8.5 wt % Si.

According to yet another preferred embodiment the alloy contains 0.001 to 0.15 wt % rare earth metals and/or scandium.

It has been found that the addition of rare earth metals or scandium improves the warm strength and creep strength of the Ti—Si alloy up to at least 675° C.

The rare earths and scandium additions form a fine dispersion of thermo-dynamically stable oxides, such as $Er_2O_3$, $Y_2O_3$ etc. in the Ti—Si alloy.

The alloy may further contains 0.1 to 1.5 wt % Cr, alternatively, the alloy may contain 0.5 to 2 wt. % Cr. The addition of Cr will enhances solid solution hardening and therefore increases the strength and will further increase the oxidation resistance of the alloy.

In the as cast state, the Ti—Si alloy possesses fine-grained hypoeutectic, eutectic or slightly hypereutectic microstructures depending upon the silicon content. The microstructure of the eutectic Ti—Si alloy consists of finely dispersed $Ti_5Si_3$ silicide particles of discontinuous rod like shape within the hexagonal close-packed α-Ti(Si) solid solution matrix. The hypoeutectic microstructure consists of primary solidified α-Ti(Si) crystals and the surrounding eutectic.

The Ti—Si alloy according to the invention has with a yield stress of at least 700 MPa, a Brinell hardness of at least 320 HB and sufficient ductility and fracture toughness-stress intensity factor $K_{IC}$ of more than 20 MPa $\sqrt{m}$.

The Ti—Si alloy according to the invention further exhibits excellent oxidation resistance up to 650° C. and above depending upon the Si content and improved wear resistance both at room and elevated temperature. The yield strength at 650° C. will be of at least $R_{P_{0.2}} \geq 250$ MPa and the tensile strength exceeds $R_m$=450 MPa.

The hypereutectic microstructures consist of primary solidified $Ti_5Si_3$ crystals of hexagonal shape within the fine-grained eutectic microstructure.

In the as cast state the hypoeutectic Ti—Si alloys exhibit at room temperature fractures toughness—$K_{IC}$-values—of more than 20 MPa $\sqrt{m}$, yield stress of more than 500 MPa with a plastic strain of more than 1.5 to 3%.

The eutectic alloy shows a fracture toughness of $K_{IC}$ of 15-18 MPa $\sqrt{m}$ and the yield stress exceeds 850 MPa at room temperature. At 600° C. and above the fracture toughness is increased to 30 MPa $\sqrt{m}$ and the strength is of the order of at least Rm=450 MPa.

Oxidation tests with exposure to air at 600° C. have resulted in an increase in mass of less than 5 mg/cm$^2$ after 500 hours. In comparison the conventional Ti—Al6—V4 alloy exhibits alpha case formation at 475° C. during long term exposure on air.

The creep stress (applied stress at given temperature where the creep rate is $\dot{\epsilon}=10^7\ s^{-1}$) of the eutectic Ti—Si alloy according to the invention is higher than 200 MPa at 600° C. In contrast the Ti—Al6—V4 alloy with potential application in the air plane and space industry exhibits a creep stress of about 150 MPa at 450° C.

The Ti—Si alloy according to the invention has a low melting point of between about 1330 and about 1380° C. The alloy according to the invention has further excellent casting properties making it possible to cast virtually any size and shape.

As a result of its spectrum of characteristics properties presented above, the Ti—Si alloy according to this invention are advantageously suitable for the manufacture of diverse components, such as:

connecting rods, piston crowns, piston pins, inlet and outlet valves and manifolds of exhaust gas mains in internal combustion engines and diesel engines;

static blades in axial flow compressors and fan blades in jet engines;

wear resistant parts in textile machines—weaving looms—like shuttles and connecting shafts;

surgical implants, bone plates, joints;

hard facings and surface alloys used as coatings in surface engineering for improving wear resistance and to avoid fretting;

watch cases;

pump cases and impellers for the chemical and oil industry.

The Ti—Si alloy according to the invention is particularly suitable for as cast components because of their relatively low melting temperatures of about 1330 to 1380° C. and excellent castability.

The Ti—Si alloy according to the invention can be produced in conventional way, such as by arc melting in a water cooled copper hearth.

DETAILED DESCRIPTION OF INVENTION

Example 1

A hypoeutectic Ti—6Si—2Al alloy according to the invention was produced by arc melting using a non consumable tungsten electrode. Titanium sponge with a purity of more than 99.8 wt %, metallurgical grade silicon and aluminium granules with a purity of more than 99.8 wt % were used as starting materials. The alloy was kept during arc melting in a water cooled copper hearth by forming a thin solid skull on the copper hearth and was then cast into a copper mould in order to achieve rod like ingots. These were machined by turning and grinding to cylindrical compression and tensile test samples exhibiting a smooth surface finish.

The Brinell hardness was determined to be about 336±3 HB 187.5/2.5 applying a testing load of 187.5 kp. The flow stress was determined at room temperature in compression test to be about $R_{P_{0.2}} \approx 725$ to 750 MPa and the plastic strain exceeds $-\epsilon_{pI}$ 10%. The fracture toughness was measured in a four point bend test. The stress intensity factor $K_{IC}$ varies between $19 \leq K_{IC} \leq 21$ MPa √m. At higher temperature of 650° C. the flow stress is still 260 $R_{P_{0.2}}$ 275 MPa and the fracture toughness is about $32 \leq K_{IC} 34$ MPa √m. The weight gain in an oxidation test on air at 600° C. was 4.5 mg/cm$^2$ after 525 hrs.

Example 2

A hypereutectic Ti—10Si alloy containing 0.2 wt % Al was also produced by arc melting technique as described above in Example 1.

The macrohardness—Brinell—of this alloy was determined to be about 365 HB 187.5/2.5 and the yield stress at room temperature ranges between $930 \leq R_{P_{0.2}} \leq 965$ MPa depending upon the grain size of the alloy. The plastic strain in compression is about 6 to 8% and the fracture toughness is in between $K_{IC}$=16 and 19 MPa √m.

At higher temperature of 650° C. the yield stress is about 330 to 360 MPa. The fracture toughness is in between 25 and 28 MPa √m. The creep strength was determined at 600° C. and exhibits values of 215 to 230 MPa in the coarse-grained state.

The oxidation on air at 650° C. leads to a weight gain of about 3.8 mg/cm$^3$ at 500 hrs exposure time.

Example 3

A hypoeutectic (near eutectic) oxide dispersion strengthened Ti—7Si—2Al alloy with addition of 0.07 mass-% Y was also produced by the arc melting technique described in example 1. Metallic Yttrium was added to the melt and formed $Y_2O_3$ with the dissolved oxygen of about 1200 ppm. The Brinell hardness was determined to be 347±2 HB 187.5/2.5. The measured yield strength was about 960 to 990 MPa. First creep experiments at 600° C. with the creep rate of $\dot{\epsilon}=10^{-7}$ s$^{-1}$ showed a creep strength in between 235 and 255 MPa.

The invention claimed is:

1. A cast titanium-silicon alloy component comprising:

2.5-12 wt. % silicon;

0.3-5 wt. % aluminum;

0-0.5 wt. % boron;

0.1-2 wt. % chromium;

0.001-1 wt. % rare earth and scandium;

a balance of titanium with unavoidable impurities;

the cast alloy having a hypoeutectic consisting of primary solidified α-Ti(Si) crystals and surrounded by eutectic microstructure, a eutectic consisting of dispersed $Ti_5Si_3$ silicide particles of discontinuous rod-like shape within a hexagonal close-packed α-Ti(Si) solid solution matrix, or a hypereutectic microstructure consisting of primary solidified $Ti_5Si_3$ crystals of hexagonal shape within a eutectic microstructure;

the cast alloy having a melting point of between 1330 and 1380° C.; and the rare earth and scandium are in fine dispersion of thermo-dynamically stable oxides in the cast alloy.

2. The cast component of claim 1, wherein the aluminum is present in an amount of 0.3 to 3 wt. %.

3. The cast component of claim 1, wherein the rare earth metal and scandium is present in an amount of 0.001-0.15 wt. %.

4. The cast component of claim 1, wherein the chromium is present in an amount of 0.5 to 2 wt. %.

5. The cast component of claim 1, wherein the boron is present in an amount of 0.01 to 0.03 wt. %.

6. The cast component of claim 1, wherein the aluminum is present in an amount of 1.1 to 3 wt. %.

* * * * *